United States Patent [19]

Mabuchi

[11] 3,934,302

[45] Jan. 27, 1976

[54] PORTABLE, MULTI-PURPOSE, RECHARGEABLE CIGARETTE LIGHTER

[76] Inventor: Kenichi Mabuchi, 3-34, Mita 2-chome, Minato, Tokyo, Japan

[22] Filed: Nov. 8, 1973

[21] Appl. No.: 413,764

[30] Foreign Application Priority Data

Nov. 14, 1972 Japan ..... 47-114183
Dec. 12, 1972 Japan ..... 47-124497

[52] U.S. Cl. ..... 15/339; 15/DIG. 1; 15/344; 15/398; 219/268; 240/6.4 CL

[51] Int. Cl.² . A47L 5/24; A47L 7/00; F21V 33/00; F23Q 7/16

[58] Field of Search ..... 15/DIG. 1, 339, 344, 398; 219/268; 240/2 CL, 6.4 R, 6.4 CL

[56] References Cited

UNITED STATES PATENTS

| | | | |
|---|---|---|---|
| 2,753,434 | 7/1956 | Storm | 15/344 X |
| 3,225,186 | 12/1965 | Duncan | 15/DIG. 1 UX |
| 3,448,365 | 6/1969 | Jacobson | 219/268 X |

FOREIGN PATENTS OR APPLICATIONS

| | | | |
|---|---|---|---|
| 795,118 | 5/1958 | United Kingdom | 15/344 |
| 237,832 | 12/1945 | Switzerland | 219/268 |
| 344,639 | 3/1960 | Switzerland | 15/DIG. 1 |
| 187,965 | 10/1966 | U.S.S.R. | 15/398 |

*Primary Examiner*—Daniel Blum

[57] ABSTRACT

A multi-purpose cigarette lighter using rechargeable Ni-Cd batteries which comprises a heated coil cigarette lighter for general smoking purpose and which further incorporates a built-in vacuum cleaner and electric lamp.

6 Claims, 10 Drawing Figures

PORTABLE, MULTI-PURPOSE, RECHARGEABLE CIGARETTE LIGHTER

BACKGROUND OF THE INVENTION

1. Field of the Invention

This invention relates to a multi-purpose cigarette lighter and, more particularly, to a portable cigarette lighter which has a coiled wire heated by rechargeable nickel-cadmium battery cells located in the body of the lighter and which is further provided with a built-in vacuum cleaner operated by said cells to work as a table cleaner, and/or with an emergency electric lamp.

2. Description of the Prior Art

The known battery-operated cigarette lighters using an electrically heated wire are of the type that ignites an inflammable gas or which utilizes a very powerful source of electricity such as a car cigarette lighter. Except for these special types, common battery-operated cigarette lighters using an electrically heated wire have been considered to be very uneconomical, because of the short life of the battery, rapidly discharged by the frequent use as well as by the relatively long time required for properly lighting of a cigarette. Furthermore, it has been considered heretofore to be very impracticable to produce a table cigarette lighter using batteries, because of the small size required and therefore of the limitation on the number of small batteries. Recently, however, the nickel-cadmium dry battery cell, for instance General Electric Company's Ni-Cd dry cell "⅔ AA," has been developed, which is small in size, has low internal resistance, affords a large discharge current (current outputs of as much as several amperes), presents small voltage drops in the initial discharge period, and can be rapidly re-charged in a manner of minutes. This makes it possible and practicable to produce a table-model or portable battery-operated multi-purpose cigarette lighter.

Because of the availability of such dry battery cells, it has now become possible to make now only a simple cigarette lighter, but also to incorporate therewith a vacuum cleaner and/or an emergency electric lamp.

SUMMARY OF THE INVENTION

An object of the present invention is to provide an electrically heated, portable cigarette lighter using rechargeable dry battery cells.

It is another object of the invention to provide a cigarette lighter which employs nickel-cadmium dry battery cells of low internal resistance and large discharge current.

It is a further object of the invention to provide a portable cigarette lighter which is equipped with an emergency electric lamp positioned in the upper or lower part of the housing.

Still another object of the invention is to provide a convenient and handy cigarette lighter which is equipped with a miniaturized vacuum cleaner for table use.

These and other objects and advantages of the present invention will become apparent from the following detailed description of the embodiments thereof, with reference to the accompanying drawings.

DETAILED DESCRIPTION OF THE EMBODIMENTS

Figure 1:
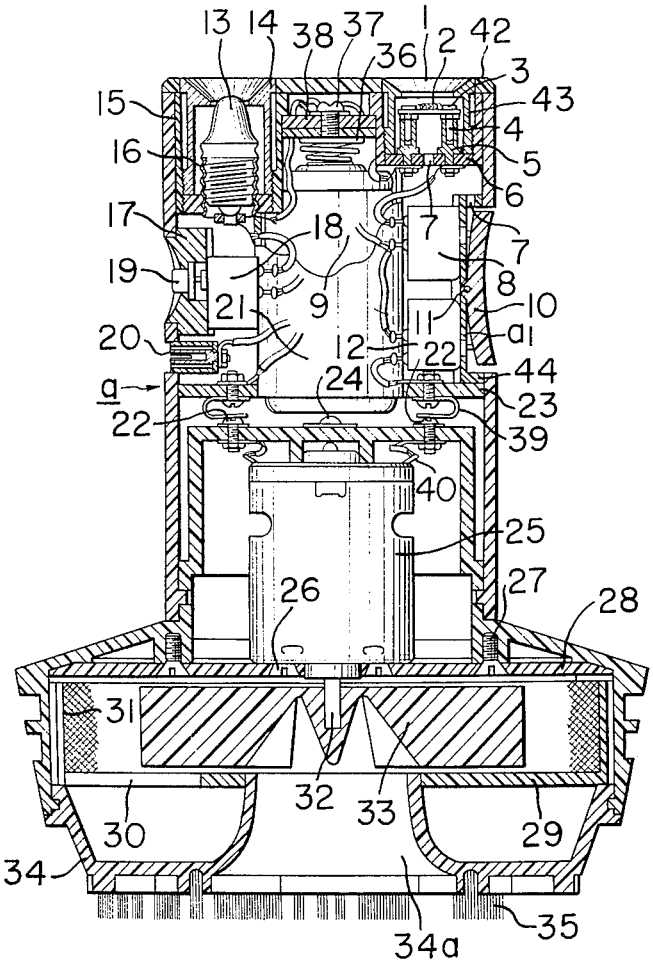
FIG. 1 is a side elevational view, in cross-section, of a combination cigarette lighter - flashlight - vacuum cleaner in accordance with the invention.

Referring now to FIGS. 1–5 the combination cigarette lighter-flashlight-vacuum vacuum cleaner will be described. The device has an upper substantially cylindrical outer housing *a* for the lighter-flashlight components. Housing *a* has suitably positioned on its outer portion, for instance on a side surface, a recess *a'* for receiving a switch lever 10 to be later described. An opening 1 is provided in the upper surface of the housing *a* for easy insertion of a cigarette. The cigarette is ignited by contacting it with an electrically heated wire 2 enclosed within a heater 3 and connected to a heater plug 4, a heater socket 5 having at least two slots (not shown clearly) for insertion therein of said plug 4. A plate 6 is supporting the socket 5, while a ventilation aperture 7 allows the circulation of air through the gap around the switch lever 10 and the switch holder 44 (to be later described). A pair of quickly re-chargeable dry battery cells 9 complete this portion of the multi-purpose device, the arrangement being such that when the wire 2 is heated to red heat by the cells, a cigarette may be readily lit by inserting it directly into opening 1. In the recessed portion *a'* of the housing *a* there is provided a switch lever 10 which is held by a holder 44 and is supported by a pivot 11, so that by pressing the upper part of said lever 10 a switch 8 is activated for heating the wire 2, while, on the other hand, by pressing the lower part of the lever 10 the vacuum cleaner switch 12 is activated for energizing a small motor 25 to be later described.

The upper housing *a* contains also a flashlight bulb 13 within a lamp case 14 and having a lamp case cover 15. A lamp socket 16, a lamp switch holder 17 and a lamp switch 18 complete this portion of the multi-purpose device. A push button 19 serves the lamp switch, so that when pressed the lamp switch 18 is activated and the lamp 13 is lit for illumination.

A socket 20 charges the cells 9 so that by inserting the plug into a source of power and connecting to to socket 20, it is possible to recharge the cells. Cells 9 are housed in a cell housing 21 in such a way that the two individual cells are connected in series, with the negative electrode of one cell short-circuited to the positive electrode of the other cell by means of a short circuiting terminal 24. This short circuiting terminal is electrically insulated from other parts of the device.

Figure 3:
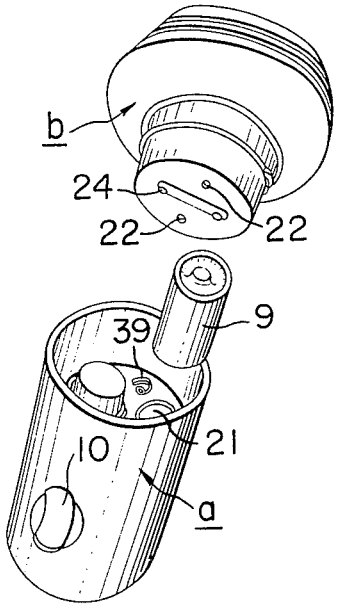
FIG. 3 is a partialy exploded, upsidedown perspective view showing the relation of the housing, the cells, and the vacuum cleaner.

A lateral connecting terminal 22 for the vacuum cleaner motor 25, an intermediate wiring element 23 and a short-circuiting terminal 24 for the cells 9 will be described later with reference to FIG. 3. The vacuum cleaner motor 25 is secured by a screw 26 to the motor supporting plate 28 which is fixed to the cleaner's housing *b* by means of screws 27. As stated before, when the cleaner switch 12 is activated, the motor 25 will rotate. Housing *b* for the vacuum cleaner is provided with an exhaust opening *b'* (not seen in FIG. 1 and FIG. 6 but seen in FIG. 5) at its outer periphery and a filter frame 29 having a filter 31 set in its peripheral inner wall. As seen more clearly in FIG. 5, the filter frame 29 is provided with a dust aperture 30 in the outer portion of its bottom surface and is also provided with an exhaust slit 41 in a more central portion of its bottom surface.

A fan 33 is press-fixed to the motor shaft 32 so that it may be rotationally driven within the space defined by said filter frame 29. A dust pan 34 is provided which has a suction opening 34*a* formed in its central region. The dust pan 34 is also provided with brushes 35. The relationship between these elements can be seen clearly in the exploded perspective view of FIG. 5. It will be understood that the dust pan 34 may be removably attached to the cleaner housing *b* by a bayonet-type insertion and the filter frame 29 is fitted in the cleaner section b and held therein by the dust pan 34.

Ashes, bread crumbs, dust, etc., which are gathered by the brushes 35 by means of the rotation of the fan 33 driven by motor 25, are sucked in together with air through the central suction opening 34*a*.

Figure 5:
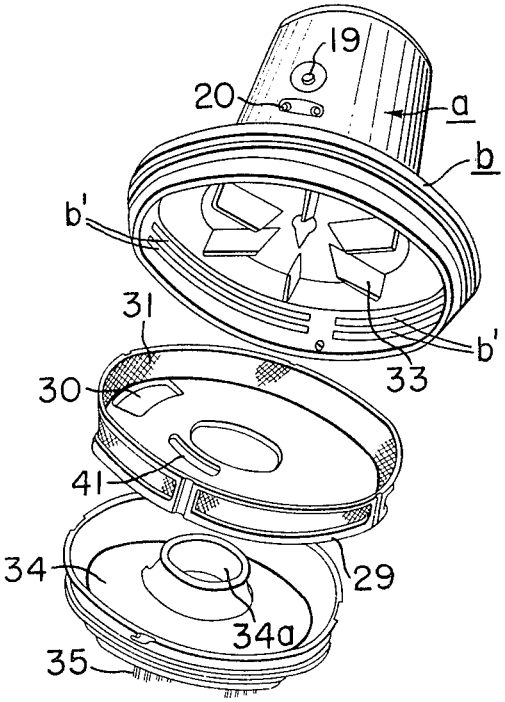
FIG. 5 is an exploded perspective view showing the components of the cleaner-section of the device.

The air sucked in is discharged to the outside through the filter 31 disposed on the filter frame 29, while the ashes, dust, etc., are led through the aperture 30 to the inside of the dust pan 34 and the air in the dust pan 34 is discharged through the discharge slit 41 (FIG. 5).

Referring again to the upper part of FIG. 1, coil springs 36 are utilized for pressing down on the cells 9, the output terminals 37 of which are supported by a plate 38. In the right-hand central portion of FIG. 1 there is shown a spring plate 39 for connecting the cells output terminals 37 to the motor side terminal 22. The input terminal of the motor 25 is indicated at 40. The upper housing *a* is enclosed by the cover plate 42, while heating coils for the cigarette lighter are encased by cover 43.

Figure 2:
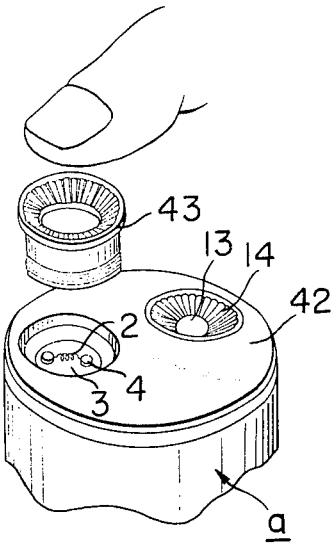
FIG. 2 is a partially exploded perspective view of the upper portion of the cigarette lighter of FIG. 1.

As shown in FIG. 2, the heater cover 43 is detachably fitted to the heater 3 and is therefore readily cleanable.

Figure 4:
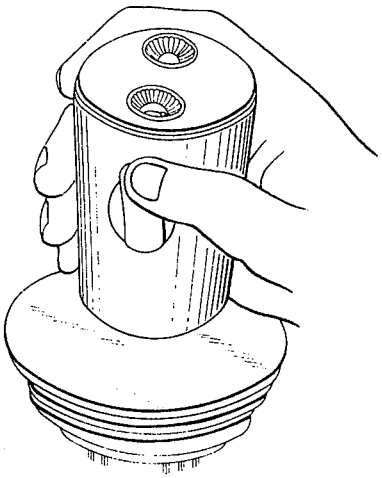
FIG. 4 shows pictorially how the upper elements of the combination are used.

With the above mentioned construction, the cigarette lighter of the invention may normally be placed on a table with the brushes 35 resting on the table surface as it can be seen from FIG. 4. From this figure one can see that one may grasp the housing *a* of the device with one hand and press the upper part of the switch lever 10 with his thumb to activate the switch 8. Then the heating wire 2 will be energized with a current of 2 or 3 amperes, thereby heating the wire 2 red-hot to light a cigarette. It is also understood that when the lower part of the switch lever 10 is pressed with the thumb to activate the switch 12, the motor 25 will be caused to become energized and to rotate by means of the spring plate 39 connected to the cells 9. Then, the brushes 35 may be brought in contact with ashes, dust, etc. on the table and these will be sucked into the dust pan 34.

Instead of pressing the switch lever 10, one may press the lamp switch button 19 which is positioned opposite to the switch lever 10, in order to light the lamp 13 for illumination purposes. As stated before, each of the cells 9 is of small size and high power, has an internal resistance low enough to supply a load of several amperes. Re-charging of the cells can be effected in a short time, generally of the order of minutes, merely by inserting a suitable plug into the shcket 20. Usually there is provided a gas discharge value for safely controlling the discharge of gas during the time of recharging.

Conversely, the conventional common nickel-cadmium cells require a charging time of the order of hours and therefore are not adequate for use in a table cigarette lighter equipped with a vacuum cleaner, such as that of the present invention; even less if the lighter is intended to serve also as an illuminating means, because the requirement of a long charging interval would nullify the convenience of the entire device.

Figure 6:
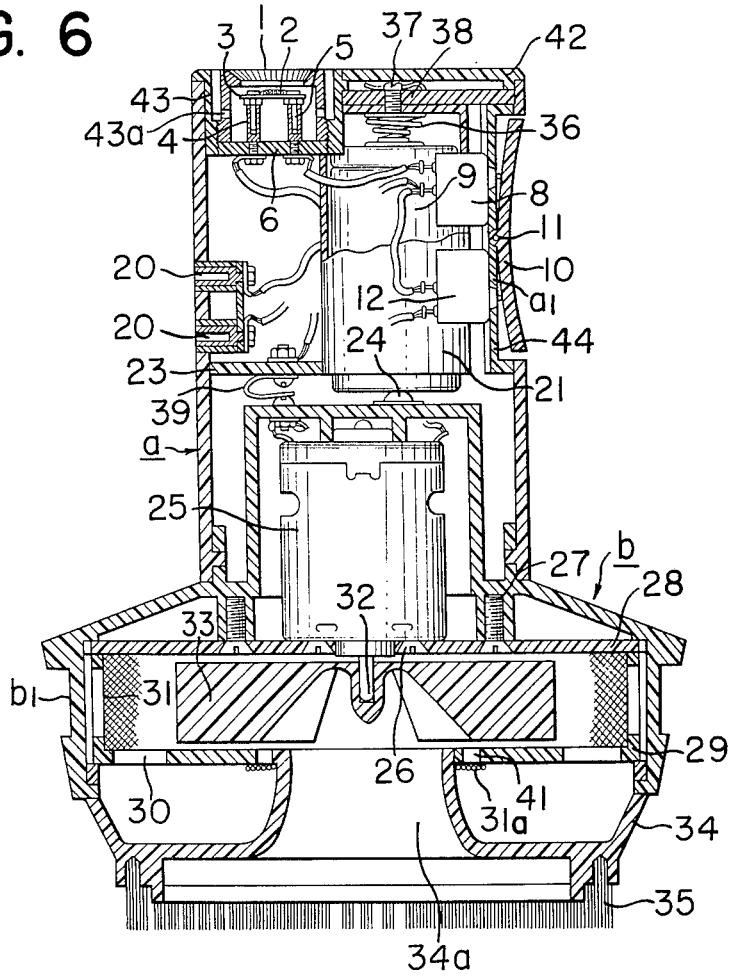
FIG. 6 is a side elevational view, in cross-section, of a variant in which the flash-light component shown in FIG. 1 is omitted.

FIG. 6 shows another embodiment combining a vacuum cleaner and a cigarette lighter the light bulb, such as shown in FIG. 1, being omitted. The difference between this embodiment and that shown in FIG. 1 lies in the omission, for the purpose of simplication, of the components related to illumination, namely the bulb 13, the lamp housing 14, the lamp cover 15, the lamp socket 16, the lamp switch holder 17, the lamp switch 18, and the lamp switch push button 19. However, there is provided the addition of filters 31*a* at the discharge slit 41, and of ventilation apertures 43*a* in the peripheral portion of the case cover 43.

Figure 7:
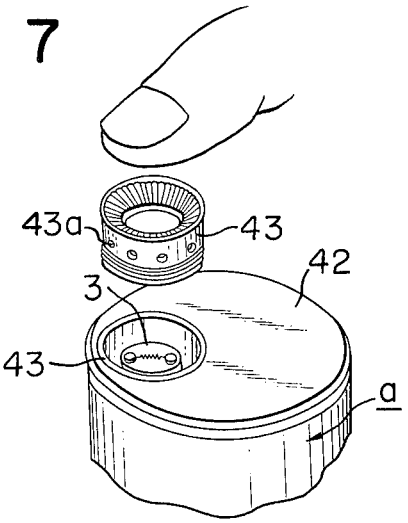
FIG. 7 is a partially exploded perpsective view of the top of FIG, 6.

FIG. 7, similiarly to FIG. 2, shows the ease of removing the case cover of the cigarette lighter component of the device for purpose of cleaning this part of the multipurpose device.

Figure 8:
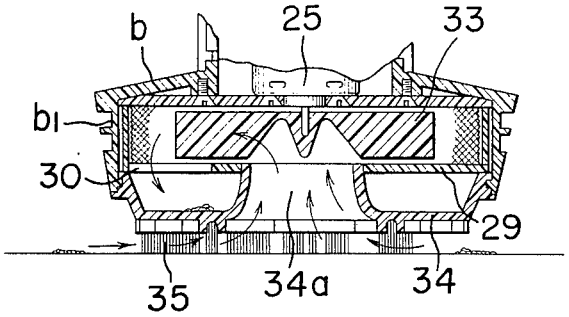
FIG. 8 is a side elevational view, in cross-section, of a variant embodiment of the vacuum-cleaner section of FIG. 6.
Figure 10:
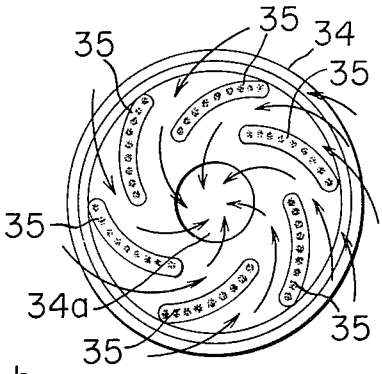
FIG. 10 is a bottom view showing the brushes of the vacuum cleaner of FIG. 8.
Figure 9:
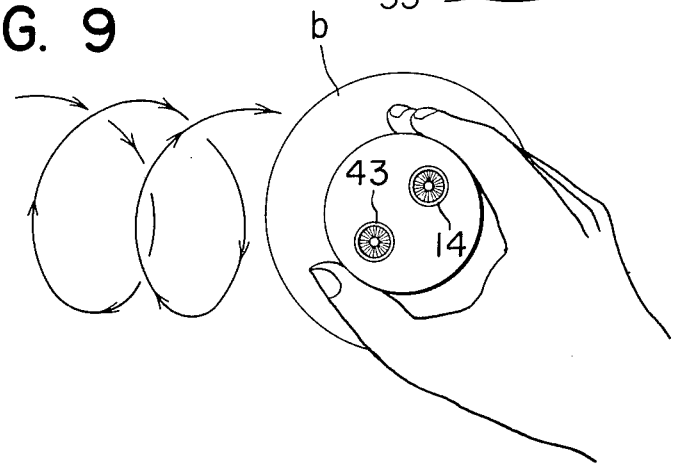
FIG. 9 is an explanatory picture showing the operation of the vacuum cleaner of FIG. 8 on a table.

FIGS. 8, 9 and 10 show a variant embodiment, in which the brushes of the vacuum cleaner are arranged spirally and are spaced from one other in order to enhance the suction efficiency of the vacuum cleaner illustrated in FIG. 1 or FIG. 6. In FIG. 8 the upper structure of the device is omitted since they are the same as in previous FIGURES. Thus, in this embodiment the focus is on the particular brushing arrangement by which not only dust, ashes, bread crumbs and the like may be removed from the table, but also dust embedded in the table cloth may be sucked up spirally with the suction air without causing resistance to the air stream.

FIG. 8 shows the flow of air produced by the rotation of the fan 33, and FIG. 9 shows a convenient way of sliding the cleaner on a table. It is apparent from the above that sufficient consideration is given to the arrangement of the brushes 35 which located on the lower surface of the dust pan 34, as shown in FIG. 10. A plurality of brush arrays 35 are arranged spirally and spaced from one another in the form of arces curved in the same direction and extending from the periphery toward the central suction opening 34*a* of the dustpan 34. By contacting a table cloth with the brush arrays so arranged, the dust particles will be stirred up and while bigger particles will be drawn toward the central suction openings 34*a* through the spaces between the brush arrays where no brushes are present, smaller particles will be drawn toward the central suction opening 34*a* not only through the same spaces but also through the spaces between the individual bristles of each brush array. The spiral suction of the air stream caused by the fan 33 is directed toward the central suction opening 34*a* through the spaces between the arcuated brush arrays in the direction of the arrows shown in FIG. 10 without resistance and dust agitation. Therefore even dust which is embedded in the table cloth will be sucked up spirally and drawn to the central suction opening 34*a* according to the same principle operating in a wind-spout. It has been customary to arrange the brushes of a cleaner in concentric circles surrounding the central suction opening. However, through the suction effect by the brushes may be still available, there is the disadvantage that the pressure in the space defined by the table surface and the central suction opening will be reduced because of the brushes being densely arranged along the circle, so that the dust will be forced to stick even more to the table cloth.

Numerous other changes and variations may be made in the above described inventive device without ever departing from the spirit of the invention. It is intended that all matter contained in the foregoing description and in the accompanying drawings shall be interpreted as illustrative and not in a limiting sense.

What is claimed is:

1. A portable, battery-operated multi-purpose cigarette lighter comprising:

an outer housing having at least one opening on the outer surface thereof;

an electric cell housing in said outer housing;

an electrically actuated heating wire held in the opening provided on the surface of said outer housing;

an on-off switch provided on the surface of said outer housing;

a pair of nickel-cadmium battery cells located in said cell housing and connected to said switch;

means for connecting said heating wire to said switch whereby said heating wire may be heated by the current from said cells flowing through said switch;

a motor disposed within said outer housing, the output shaft of said motor being located in the lower part of said outer housing;

a vacuum cleaner housing, the upper portion of which is located in the lower part of said outer housing;

a fan provided within said vacuum cleaner housing and rotatably secured on the output shaft of said motor;

a filter frame inserted removably into said vacuum cleaner housing and having a filter at the periphery thereof;

a dust pan having a central suction opening and a dish-shaped member at the periphery thereof, the upper portion of which is removably fitted to the lower portion of said vacuum cleaner housing;

brushes embedded around the peripheral portion of said suction opening in the bottom surface of said dust pan; and means for connecting said motor to said switch whereby said motor may be driven by the current from said cells flowing through said switch, and said portable, battery-operated multi-purpose cigarette lighter being capable of independently standing on a table by said brushes.

2. A portable, battery-operated multi-purpose cigarette lighter adapted to be operated by battery means comprising:

an outer housing having at least one opening on the outer surface thereof;

an electric cell housing in said outer housing and adapted to receive the battery means;

an electrically actuated heating wire held in the opening provided on the surface of said outer housing;

an on-off switch provided on the surface of said outer housing;

means for connecting said heating wire to said switch whereby said heating wire may be heated by the current from the battery means flowing through said switch;

a motor disposed within said outer housing, the output shaft of said motor being located adjacent the lower part of said housing;

a vacuum cleaner housing, the upper portion of which is located in the lower part of said outer housing;

a fan provided within said vacuum cleaner housing and rotatably secured on the output shaft of said motor;

a filter frame inserted removably into said vacuum cleaner housing and having a filter at the periphery thereof;

a dust pan having a central suction opening and a dish-shaped member at the periphery thereof, the upper portion of which is removably fitted to the lower portion of said vacuum cleaner housing;

brushes having one end thereof embedded around the peripheral portion of said suction opening in the bottom surface of said dust pan the other end of said brushes defining a support surface that is in a plane that is transverse to the longitudinal axis of said outer housing whereby said lighter is capable of independently standing upright on said brushes; and means for connecting said motor to said switch whereby said motor may be driven by the current from the battery means flowing through said switch.

3. The cigarette lighter as claimed in claim 1, in which each nickel-cadmium cell has a small internal resistance and is provided with means for discharging gas during re-charging.

4. The cigarette lighter as claimed in claim 1, in which said outer housing also includes an illumination lamp.

5. The cigarette lighter as claimed in claim 4, in which said illuminating lamp is located in the top portion of said outer housing.

6. The cigarette lighter as claimed in claim 1, in which said brusher ore arrays arranged spirally and in spaced relationship from one another and extending from the outer periphery of said bottom surface of said dust pan toward said central suction opening.

* * * * *